United States Patent [19]

Matsushima

[11] 4,372,698

[45] Feb. 8, 1983

[54] DRIVING DEVICE FOR A PRINT HEAD OF A PRINTER

[76] Inventor: Akira Matsushima, 1-1, Taihei 4-chome, Sumida-ku, Tokyo, Japan

[21] Appl. No.: 241,537

[22] Filed: Mar. 9, 1981

[30] Foreign Application Priority Data

Mar. 11, 1980 [JP] Japan ..... 55-30668
Nov. 13, 1980 [JP] Japan ..... 55-159948

[51] Int. Cl.[3] ..... B41J 19/20; B41J 25/30

[52] U.S. Cl. ..... 400/320; 400/328; 74/37

[58] Field of Search ..... 400/320, 322, 328, 120, 400/323; 346/76 PH; 101/93.05; 74/37

[56] References Cited

U.S. PATENT DOCUMENTS

| | | | |
|---|---|---|---|
| 3,817,365 | 6/1974 | Zimmermann | 101/93.05 X |
| 3,904,010 | 9/1975 | Krauss et al. | 101/93.05 X |
| 4,034,842 | 7/1977 | Giacone | 400/322 X |
| 4,084,681 | 4/1978 | Heinzl et al. | 400/320 X |

FOREIGN PATENT DOCUMENTS

| | | | |
|---|---|---|---|
| 2309340 | of 1976 | France | 400/328 |

OTHER PUBLICATIONS

IBM Technical Disclosure Bulletin, vol. 21, No. 1, Jun. 1978, pp. 284–285, "Low Cost Thermal Printer", Cutshall et al.

*Primary Examiner*—Edgar S. Burr
*Assistant Examiner*—Charles Pearson
*Attorney, Agent, or Firm*—Robert E. Burns; Emmanuel J. Lobato; Bruce L. Adams

[57] ABSTRACT

A driving device for a print head of a printer comprises an endless belt rotating in one direction and a drive pin secured to the belt. The drive pin is put in a long hole in a carriage. A print head is slidably supported on the carriage toward a platen. The drive pin moves the carriage transversely and shifts the print head to and away from the platen.

2 Claims, 8 Drawing Figures

DRIVING DEVICE FOR A PRINT HEAD OF A PRINTER

The present invention relates to a driving device for a print head of a printer and more particularly to a driving device for a print head of a non-impact type printer such as an electro-sensitive type in which a print head is kept in contact with a platen by a certain pressure during its printing operation.

In a printer of an electro-sensitive type, a print head is driven transversely with its electrode pins contacting with a paper on the platen during the printing operation, and it is returned to its home position with the electrode pins kept out of contact with the paper when one stroke of a printing operation is over. In a conventional printer of the electro-sensitive type, a driving device for slidably moving a print head transversely and a device for moving the electrode pins in and out of contact with a print paper are seperately provided. Therefore the structure is complex and expensive to manufacture.

According to a feature of the present invention, there is provided a driving device for a print head of a printer comprising; a pair of belt wheels set in parallel to a platen, an endless belt entrained around the belt wheels, a drive means for rotating at least one of the belt wheels in one direction, a drive pin secured to the belt and projecting upwards, a carriage slidably movable in parallel to the platen, the carriage being provided with a long hole extending at a right angle with the platen and engaging with the drive pin, a print head, a support member of the print head slidably supported on the carriage at a right angle with the platen, a coil spring for biasing the support member toward the platen and a shift means for moving the support member away from the platen against the force of the coil spring as the drive pin moves away from the platen.

One object of the present invention is to provide a device for driving a print head in which the transversely sliding operation and the back and forth motion of the print head can be performed by a very simple linked mechanism.

Figure 1:
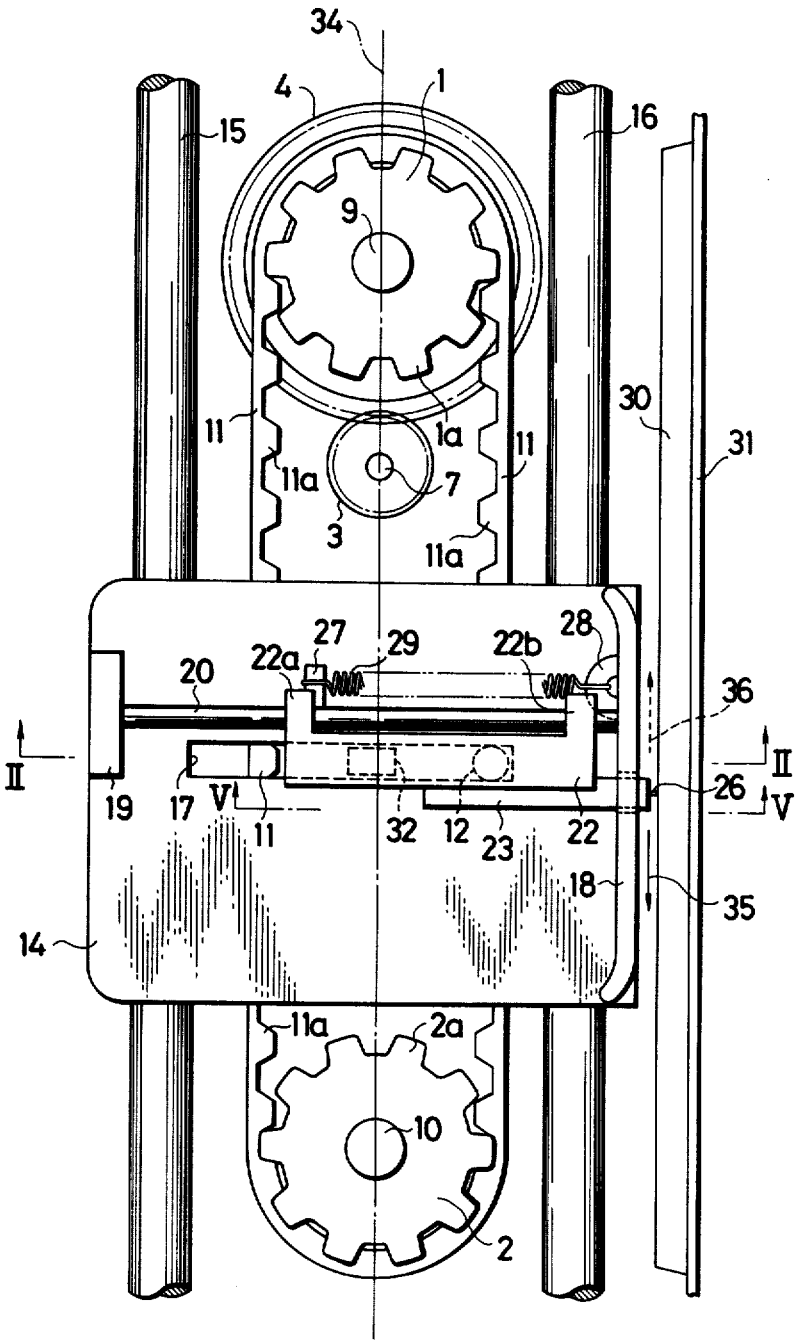
Figure 2:
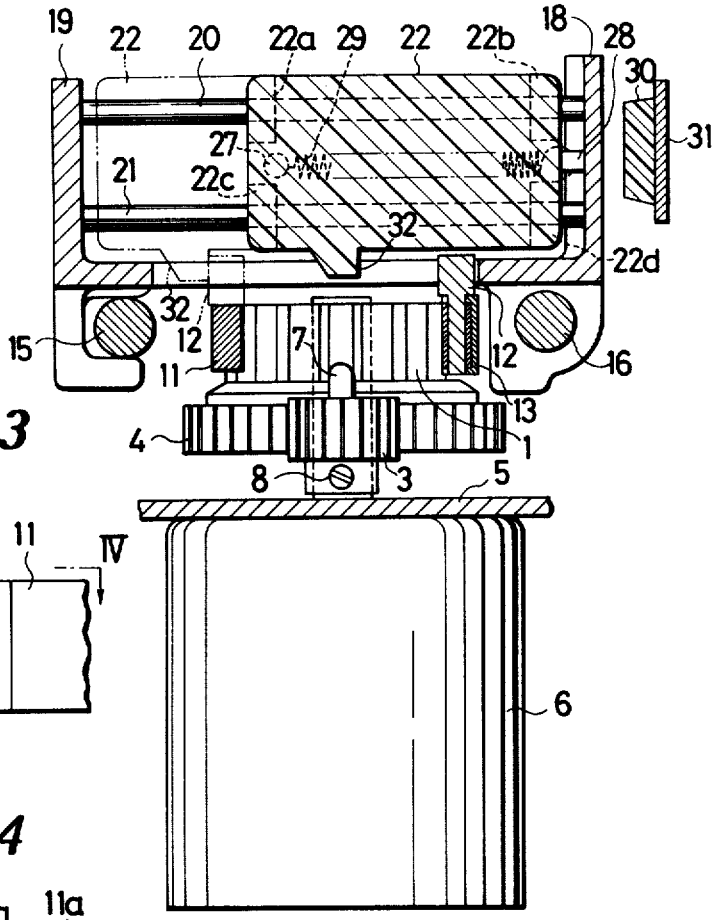
Figure 3:
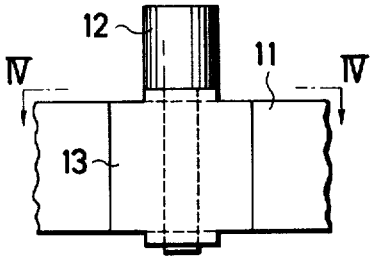
Figure 4:
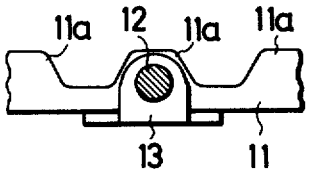
Figure 5:
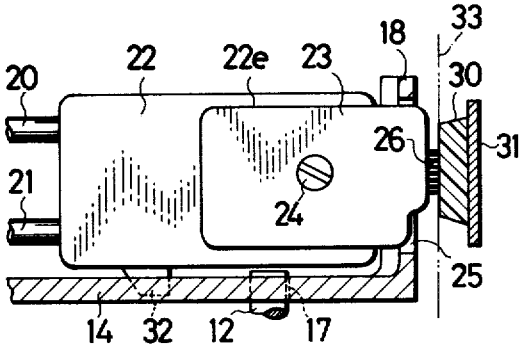
Figure 6:
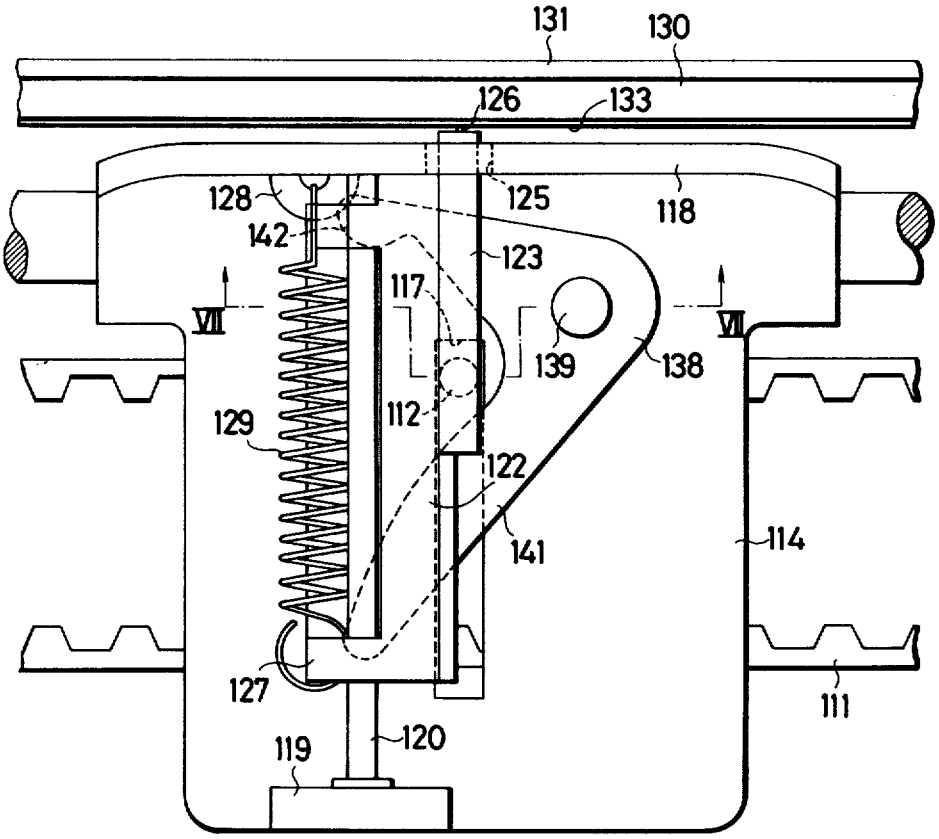
Figure 7:
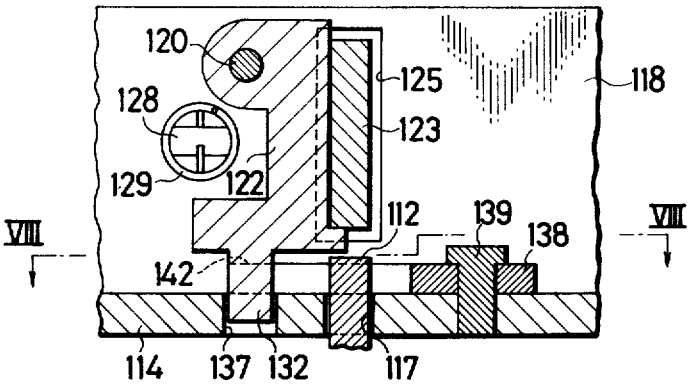
Figure 8:
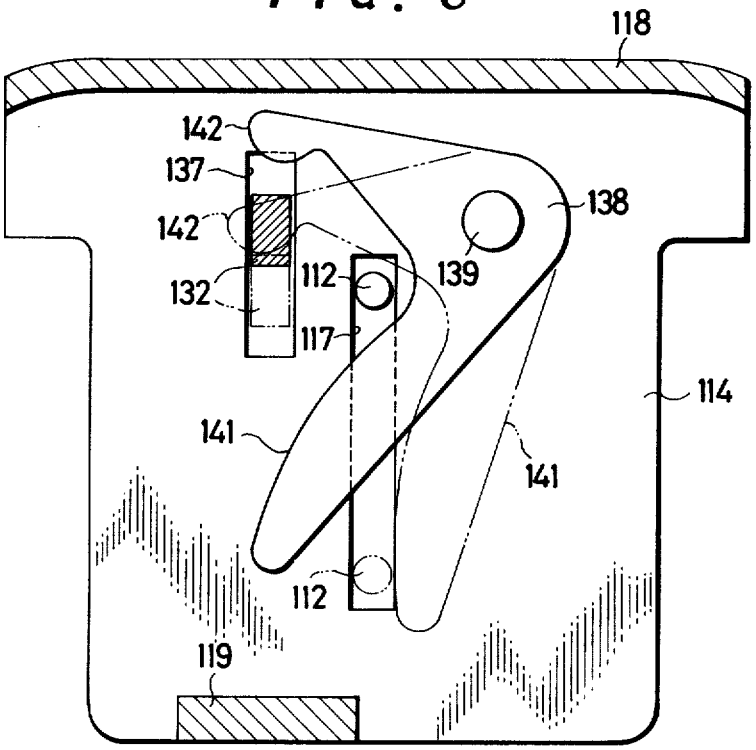

The above object as well as other objects and characteristic features of the present invention will become evident and will be more readily understood from the following description and claims taken in conjunction with the accompanying drawings in which;

FIG. 1 is plan view of an essential part of one embodiment according to the present invention, FIG. 2 is a sectional view along lines II—II in FIG. 1, FIG. 3 is an enlarged elevational view of a drive pin secured to a belt, FIG. 4 is a sectional view along lines IV—IV in FIG. 3, FIG. 5 is sectional view partly broken away along lines V—V in FIG. 1, FIG. 6 is a plan view of an essential part of another embodiment according to the present invention, FIG. 7 is a sectional view along lines VII—VII in FIG. 6, and FIG. 8 is a sectional view along lines VIII—VIII in FIG. 7.

Referring to FIGS. 1 to 5, one embodiment will now be explained.

In FIGS. 1 and 2, belt wheels 1, 2 which function as timing wheels are rotatably mounted with a predetermined distance therebetween. One belt wheel 1 is provided with an intermediate gear wheel 4 which meshes with a motor pinion 3. The motor pinion 3 is connected to a motor shaft 7 of a driving motor 6 by a screw 8. The motor 6 is secured to the backside of a frame 5. The belt wheels 1, 2 are rotatably supported by shafts 9, 10 respectively. The shafts 9, 10 are connected on the frame 5. An endless belt 11 is entrained around the belt wheels 1, 2. The endless belt 11 functions as a timing belt and is provided with a plurality of interior teeth 11*a* which engage with teeth 1*a*, 2*a* of the belt wheels 1, 2. A drive pin 12 is secured to one tooth 11*a* of the belt by means of a support plate 13 and stands upwards as shown in FIGS. 3 and 4. The pin 12 is so arranged that the support plate 13 does not obstruct the engagement between the belt 11 and the wheels 1, 2. A carriage 14 is supported in a slidable manner by two parallel guide shafts 15, 16. The carriage 14 is provided with integral upward projections 18, 19 at its front and rear sides respectively. Two guide shafts 20, 21 are supported by the projections 18, 19 and extend parallel to an elongated or long hole 17. A support member 22 is provided with four projections 22*a*, 22*b*, 22*c*, 22*d* at four corners of its one side. The guide shaft 20 penetrates through the projections 22*a*, 22*b* and the other guide shaft 21 penetrates through the projections 22*c*, 22*d*. By such a construction the support member 22 is kept slidable along the long hole 17. The support member 22-carries a print head 23 in its recessed portion 22*e* by a screw 24 as shown in FIGS. 1 and 4. The print head 23 has a front portion protruding through a hole 25 in the projection 18 of the carriage 14. The print head 23 is provided with a plurality of electrode pins 26 projecting from the front portion. The support member 22 is provided with a pin 27 at its one side. A coil spring 29 is connected at opposite ends between the pin 27 and a hook 28 projecting from the projection 18. The support member 22 as well as the print head 23 is always biased forward. Thus the electrode pins 26 are urged into contact with a platen 30 by the force of the coil spring 29. The platen 30 is made of hard rubber and is connected to a holder 31. The platen 30 is made long enough to cover the range of movement of the print head 23. The support member 22 is provided with a projection 32 at its lower portion. The projection 32 slidably extends in the long hole 17 of the carriage 14. The projection 32 positions inside of the locus of the drive pin 12, and preferably its front side positions on or right side to a central line 34 connecting the centers of the shafts 9 and 10 in FIG. 1.

In operation, as the motor 6 operates, the belt wheel 1 is rotated in the clockwise direction in FIG. 1 at a constant speed, and the belt 11 is also rotated by the wheel. The drive pin 12, which projects in the long hole 17, pushes the carriage in the direction shown by an arrow 35 in FIG. 1. As the support member 22 is pulled forward by the coil spring 29, the electrode pins 26 contact a print paper 33 as shown in FIG. 5, and while keeping this state of the pins, the print head 23 moves transversely in the direction shown by the arrow 35. During the movement of the print head 23, voltage is selectively applied to the electrode pins 26 to print characters or the like by a dot matrix on the paper 33. When the drive pin 12 comes to the belt wheel 2 and begins to rotate about the wheel, it begins to move towards the left in the hole 17 in FIG. 1. As the drive pin 12 further rotates around the belt wheel 2, it pushes the projection 32 backwards against the force of the coil spring 29. The support member 22 is thus positioned as shown in phantom lines in FIG. 2, and the print head 23 is shifted backward with its electrode pins 26 out of contact with the print paper 33. When the drive pin 12 passes the central line 34 in FIG. 1, the carriage 14 starts to return in the direction shown by an arrow 36 in broken line. As the drive pin 12 begins to rotate around the belt wheel 1, it starts to move forward in the long hole 17 in FIG. 2. The support member 22 also moves accordingly. As soon as the drive pin 12 passes the central line 34, the carriage 14 begins to move in the reverse direction shown by the arrow 35. When the drive pin 12 moves further the electrode pins 26 come in contact with the print paper 33 on the platen by the force of the coil spring 29. The print head 23 can move forward no further and the drive pin 12 comes out of contact with the projection 32 gradually to finally restore its position as shown in solid lines in FIG. 2.

The operation described above is repeated every one cycle of the belt 11 and the drive pin 12.

FIGS. 6 to 8 show another embodiment of the present invention.

In FIGS. 6 to 8, parts corresponding to those in the former embodiment bear the same reference numerals increased by 100.

In the present embodiment, the carriage 114 is provided with another guide hole 137 in parallel to the long hole 117. The projection 132 descending from the support member 122 extends in the guide hole 137. A reset lever 138 is rotatably supported on the carriage 114 by a pin 139. The reset lever 138 is bifurcated and provided with two arms 141, 142. One arm 142 extends to the front of the projection 132 as shown in FIG. 8, and the other arm 141 extends crossing the long hole 117 aslant to the front of the drive pin 112. When the drive pin 112 comes to the belt wheel at the right side(not shown in the drawings), the drive pin 112 moves backwards and pushes the arm 141. The lever 138 is turned counterclockwise and the arm 142 pushes the projection 132 backward. Thus the electrode pins 126 come out of contact with the print paper 133. The carriage 114 is moved leftwards by the drive pin 112. When the drive pin 112 comes to mesh the belt wheel at the left side, it begins to move forward. The lever 138 rotates clockwise to let the carry member 122 move forward by the force of the coil spring 129, and the electrode pins 126 come in contact with the print paper 133. In the present embodiment, little load is applied to the drive pin 112 in the direction at a right angle to the movement of the pin. Thus there is no fear that the belt 111 is twisted and the belt thus rotates smoothly.

What is claimed is:

1. A driving device for a print head of a printer having an elongated platen comprising:

a pair of rotatable belt wheels disposed in spaced relationship along a line extending generally parallel to the platen;

an endless belt entrained around said belt wheels;

drive means for rotationally driving at least one of said belt wheels in one direction;

a drive pin secured to said belt and projecting upwards;

a carriage slidably movable in parallel to the platen, said carriage being provided with an elongated hole extending at approximately a right angle with respect to the platen and slidably receiving therein said drive pin;

a print head having a support member slidably supported on said carriage at approximately a right angle with respect to the platen;

a coil spring for biasing said support member toward the platen; and shift means for moving said support member away from the platen against the force of said coil spring as said drive pin moves away from the platen, the shift means comprising a projection extending downwards from said support member into said elongated hole such that said projection is pushed backwards by said drive pin against the force of said coil spring when said drive pin moves away from the platen.

2. A driving device for a print head of a printer having an elongated platen comprising:

a pair of rotatable belt wheels disposed in spaced relationship along a line extending generally parallel to the platen;

an endless belt entrained around said belt wheels;

drive means for rotationally driving at least one of said belt wheels in one direction;

a drive pin secured to said belt and projecting upwards;

a carriage slidably movable in parallel to the platen, said carriage being provided with an elongated hole extending at approximately a right angle with respect to the platen and slidably receiving therein said drive pin;

a print head having a support member slidably supported on said carriage at approximately a right angle with respect to the platen;

a coil spring for biasing said support member toward the platen; and shift means for moving said support member away from the platen against the force of said coil spring as said drive pin moves away from the platen, the shift means comprising a bifurcated reset lever rotatably supported on said carriage and having two lever arms, a guide hole provided in said carriage extending parallel to said elongated hole, and a projection extending downwards from said support member into said guide hole, whereby when said drive pin moves backwards it pushes one arm of said reset lever to cause the other arm to push said projection backwards.

* * * * *